United States Patent [19]

Combs

[11] 4,374,709

[45] Feb. 22, 1983

[54] PROCESS FOR PLATING POLYMERIC SUBSTRATES

[75] Inventor: Daniel J. Combs, Sterling Heights, Mich.

[73] Assignee: Occidental Chemical Corporation, Warren, Mich.

[21] Appl. No.: 145,534

[22] Filed: May 1, 1980

[51] Int. Cl.[3] ..... C25D 5/56

[52] U.S. Cl. ..... 204/30; 204/38 B; 204/52 R

[58] Field of Search ..... 204/30, 38 B, 52 R; 427/437

[56] References Cited

U.S. PATENT DOCUMENTS

| | | | |
|---|---|---|---|
| 3,328,273 | 6/1967 | Creutz et al. | 204/52 R |
| 3,682,788 | 8/1972 | Kardos et al. | 204/52 R |
| 3,751,289 | 8/1973 | Arcilesi | 204/38 B X |
| 3,954,570 | 5/1976 | Shirk et al. | 204/15 |

OTHER PUBLICATIONS

Frederick Lowenheim, *Electroplating*, McGraw-Hill Book Co., New York, 1978, pp. 389–391, 410–415.

*Primary Examiner*—Winston A. Douglas
*Assistant Examiner*—William Leader
*Attorney, Agent, or Firm*—Richard P. Mueller

[57] ABSTRACT

A process for pretreating a substantially non-conductive substrate such as a plateable plastic or plastic article having an electroless metal deposit on the surface thereof which comprises the steps of conditioning the surface of the substrate to effect an increase in the conductivity thereof with a dilute aqueous acidic solution containing controlled effective amounts of copper, acid and a polyether compound followed by an electrolytic acid copper strike employing a more concentrated aqueous electrolyte containing copper, acid and a polyether compound. The conditioning and electrolytic copper strike steps can be performed without necessitating any intervening rinse steps to provide a conductive basis for subsequently depositing adherent and uniform electroplates such as decorative acid copper or the like.

20 Claims, No Drawings

PROCESS FOR PLATING POLYMERIC SUBSTRATES

BACKGROUND OF THE INVENTION

The use of parts comprised of a polymeric substrate such as plastic having an electrodeposited coating on all or portions of the surfaces thereof has received widespread commercial acceptance for a variety of utilitarian and decorative purposes including automobile trim components. Various processes and techniques have heretofore been used or proposed for applying such metallic coatings on polymeric substrates including pretreatments to activate the plastic surface followed by the deposition of an electroless metal deposit whereafter the part can be subjected to further electroplating operations. More recently, so-called "plateable" plastics have been developed which incorporate conductive filler materials such as graphite to enable direct electroplating of the substrate without necessitating the prior surface activation and electroless plating steps. In addition to the problems associated with such prior art processes including high costs, complexity of the process, low efficiency in the electroplating cycle and necessity of waste treatment of the several intervening rinse treatments, a further problem has arisen as a result of the loss of adhesion between the overlying metallic layer and the substrate as evidenced by blistering when such plated parts are subjected to elevated temperatures such as may occur during the baking or curing cycle of painted plastic parts as well as during service.

In accordance with the guidelines established by the American Society of Electroplated Plastics, a minimum thickness of copper deposit on the plastic substrate has been specified depending on the severity of service in order for such plated plastic articles to pass thermocycle testing. According to ASEP guidelines, a copper deposit of at least about 5 to about 10 micrometers is specified for minimum service with copper thicknesses of as high as about 15 to about 20 micrometers for heavy duty service. The deposition of the copper plate is primarily accomplished by a conventional acid copper plating solution usually containing primary and secondary brightening agents to provide a conductive decorative copper deposit. Subjection of plastic substrates having an electroless plate on the surfaces thereof directly to such acid copper plating operations has frequently resulted in a burn-off of the electroless plate at the contact points and a loss of adhesion of the copper plate to the substrate. In order to avoid burn-off, it has heretofore been necessary to substantially reduce the initial voltage and amperage of the acid copper electroplating step to provide for a progressive build-up of the copper deposit which has resulted in a substantial loss in efficiency accompanied by excessive plating times.

In an effort to overcome the foregoing problem it has also been proposed to apply a nickel strike employing a Watts nickel bath over the electroless plated plastic part to build-up a conductive nickel plate of a thickness usually up to about 0.0001 inch. This proposal also has the disadvantages that it is necessary to subject the part with the nickel strike thereon to usually two intervening water rinse treatments before entering the subsequent acid copper plating solution necessitating waste disposal treatment of the rinse solutions in order to enable them to be harmlessly discharged to waste. Additionally, the cost of such nickel baths are comparatively high and the nickel plate or strike deposited cannot be included to fulfill the requirements of minimum copper deposits in accordance with the guidelines established by the ASEP.

Alternatively, it has heretofore been proposed to employ a copper pyrophosphate electrolyte for applying a copper strike to the substantially non-conductive plastic substrate such as an electroless plating deposit to render the part suitable for further copper plating employing a conventional acid copper electrolyte. Unfortunately, such copper pyrophosphate electrolytes are difficult to control to consistently obtain a uniform copper strike and the cost of the bath is relatively high. Additionally, at least two intervening rinses are required between the copper strike and subsequent acid copper decorative plate necessitating further costly waste treatment of the rinse solution.

The problems and cost disadvantages associated with prior art techniques for electroplating plastics are overcome in accordance with the process of the present invention whereby an adherent copper strike is applied to a substantially non-conductive substrate which contributes toward the minimum copper guidelines as established by the ASEP and whereby the part can be directly transferred from the strike bath to the decorative acid copper electrolyte without necessitating any intervening rinse treatments. The process of the present invention is further characterized by the economy of the conditioning and copper strike bath, the ease of control of the process to achieve consistently uniform and adherent copper deposits and wherein any dragout from the strike solution to the subsequent decorative acid copper solution effects a replenishment of the latter providing for further economies and a conservation of chemical constituents.

SUMMARY OF THE INVENTION

The benefits and advantages of the present invention are achieved by a process which for the first time enables the use of an acid copper strike on a substantially non-conductive substrate enabling the substrate to thereafter, without any intervening rinse treatment, to be directly transferred to a decorative acid copper plating bath for further electrodeposition of copper to the required thickness. In accordance with the present process, a substantially non-conductive substrate such as a plateable plastic or a plastic having an electroless plate thereover is first contacted with a dilute aqueous conditioning solution containing controlled effective amounts of copper ions, an acid and a bath soluble polyether compound for a period of time sufficient to effect an immersion deposit of copper ions on the substrate thereby significantly reducing the resistivity of the substrate. The conditioned substrate is thereafter provided with an electrolytic copper strike employing an aqueous acidic electrolyte containing copper ions, an acid and a bath soluble polyether compound which are present in controlled amounts sufficient to deposit a uniform, adherent and conductive copper strike layer on the substrate. The substrate with the copper strike can thereafter be directly transferred to a conventional decorative acid copper electroplating bath for further deposition of copper to the desired thickness without an intervening rinse or, alternatively, can be rinsed and subjected to alternative electrolytic plating operations as may be desired.

The acid copper strike bath may optionally contain conventional primary and secondary brightening agents to impart the requisite qualities to the copper strike deposit.

Additional benefits and advantages of the present process will become apparent upon a reading of the description of the preferred embodiments taken in conjunction with the specific examples provided.

DESCRIPTION OF THE PREFERRED EMBODIMENTS

The process of the present invention is particularly applicable for depositing a uniform adherent copper strike on substantially non-conductive substrates such as plateable plastics and plastic articles which have been processed through various pretreatment steps to provide the surface thereof with an electroless plate or deposit comprising nickel, cobalt, nickel-iron and nickel-cobalt alloys. Considerable development work is currently underway to provide so-called "plateable" plastic materials incorporating a conductive filler at least in the surface stratum thereof enabling them to be directly electroplated thereby dispensing with the need for conventional pretreatment procedures to apply an electroless deposit. A typical plateable plastic of the foregoing type which is commercially available is sold under the brand name Caprez-DPP, available from Alloy Polymers of Waldwick, N.J.

Polymeric materials or plastics which are subject to electroplating at the present time are primarily acrylonitrile-butadiene-styrene although polyaryl ethers, polyphenylene oxide, nylon and like polymers are also in use. Because such plastic substrates such as ABS have higher coefficients of expansion than typical metal parts, the electrodeposit on the substrate must be extremely ductile so that it will expand and contract with the thermal expansion of the plastic without incurring cracking, blistering, or peeling. A bright decorative acid copper electroplating step produces a ductile copper deposit which has the ability to expand and contract with the plastic substrate thereby acting as a buffer for the relatively brittle overlying plates of nickel and chrome. However, the higher voltage requirements of such bright decorative acid copper electroplating baths has occasioned burn-off of the electroless deposit of a pretreated plastic substrate or has occasioned poor adhesion of the copper deposit and subsequent electrodepositions to the substrate occasioning blistering, peeling or cracking when subjected to temperature fluctuations. For this reason, it is important that the substantially non-conductive plastic substrate be provided with a copper strike prior to the decorative acid copper electroplating step to prevent dissolution or loss of electrical conductivity of the electroless deposit achieving a uniform and adherent copper deposit.

The term "substantially non-conductive substrate" as herein employed is intended to distinguish over metal substrates such as iron, steel, aluminum, etc. which are highly conductive and can be directly subjected to decorative acid copper electroplating without adverse effect. Plateable plastics and pretreated plastic substrates having an electroless deposit thereon qualify as "substantially non-conductive substrates" and typically have a sheet or surface resistance of about 5 to about 2500 ohms per linear inch. In accordance with the present process, the conditioning step serves to provide an immersion copper deposit on the substrate substantially reducing the resistivity thereof followed by the acid copper strike which deposits a highly conductive uniform adherent copper strike which enables the part to be directly transferred to conventional acid copper decorative electroplating operations or other electroplating steps employing concentrated solutions and relatively high voltages without adverse effects on the initial plate deposits.

The pretreatment of polymeric materials such as plastics to apply an electroless deposit on the surface thereof does not comprise a part of the present invention and can be achieved in accordance with any of the techniques well known in the art such as those described in U.S. Pat. Nos. 3,622,370; 3,961,109; and 3,962,497 to which reference is made for further details of the pretreatment processes. Briefly stated, the pretreatment steps of such prior art processes comprise one or a series of cleaning steps if necessary to remove surface films or contaminating substances from the plastic substrate followed thereafter by an aqueous acidic etching step employing a hexavalent chromium solution to achieve a desired surface roughness or texture thereby enhancing a mechanical interlock between the substrate and the metallic deposit to be applied thereover. The etched substrate is thereafter subjected to one or a plurality of rinse treatments to remove any residual hexavalent chromium ions on the surfaces of the substrate which may additionally include a neutralization step. The etched substrate is then subjected to an activation treatment in an aqueous acidic solution containing a tin-palladium complex to form active sites on the surface of the substrate which is followed by one or more rinsing steps after which the surface is subjected to an accelerating treatment to extract any residual tin constituents or compounds on the surface of the substrate. The accelerated plastic part is again rinsed whereafter it is subjected to an electroless plating operation of any of the types known in the art to apply a metallic plate such as nickel, cobalt, nickel-iron, nickel-cobalt over all or selected areas of the part whereafter the part is again rinsed and is then in condition for processing in accordance with the practice of the present invention.

Plateable plastics may also be subjected to one or a plurality of cleaning treatments to remove any surface films or contaminating substances on the surfaces thereof, if necessary, followed by one or more rinse treatments in which they are then in condition for treatment in accordance with the practice of the present invention.

In accordance with the present invention, the pretreated plastic substrate or plateable plastic after appropriate rinsing is subjected to a conditioning step in which it is contacted with a conditioning solution comprising a dilute aqueous acidic solution containing copper ions, an acid and a polyether compound as the essential constituents present in amounts effective to deposit copper by immersion on the plastic substrate reducing the resistivity of the surface thereby minimizing burn-off at the contact points during the subsequent strike step and providing for improved adhesion of the copper strike. The conditioning step further eliminates heavy non-uniform copper deposits resulting during the acid copper strike without the intervening conditioning step which can result in the formation of striations in the plated surface. The conditioning solution contains as its essential constituents from about 0.05 to about 5 grams per liter (g/l) of copper ions with concentrations of about 0.25 to about 2 g/l being preferred. The copper ions can be conveniently introduced in the form of bath soluble salts including copper sulfate, copper fluoroborate, copper acetate, copper nitrate, as well as the alkali metal, magnesium and ammonium acid salts thereof. Of the foregoing materials, copper sulfate pentahydrate is a particularly convenient form of introducing the copper ions and constitutes the preferred material.

The acid in the conditioning solution comprises sulfuric acid, fluoroboric acid, acetic acid, nitric acid as well as mixtures of the foregoing of which sulfuric acid itself is preferred. The acid concentrations can range from about 0.5 to about 40 g/l with concentrations of about 2 to about 25 g/l being preferred. Acid concentrations below about 0.5 g/l tend to produce a non-adherent immersion copper coating during the conditioning step and during the subsequent strike and electroplating steps while concentrations above about 40 g/l have a tendency to chemically attack and adversely effect the electroless deposit depending upon the specific type of electroless metal employed, the temperature of the conditioning solution and the duration of the conditioning step.

The plastic substrate can be contacted with the conditioning solution in any of the manners well known in the art including immersion, flooding, spray application, etc. No agitation is required although air agitation is desirable in some instances. The conditioning solution is controlled within a temperature of about 60° to about 150° F. with temperatures ranging from 70° to about 120° F. being preferred. The duration of the conditioning step can range from a minimum of about 15 seconds up to a time before adverse chemical attack or etching of the surface of the substrate occurs which will vary depending upon the temperature of the conditioning bath, the concentration of the constituents therein and the thickness and type of the electroless deposit. Usually, time periods of about 30 seconds to about 2 minutes are employed on plastic substrates having an electroless deposit thereon. Treating durations beyond about 2 minutes do not provide any appreciable advantage over that obtained with treating times of about 2 minutes or less. The conditioning of plateable plastic articles can employ treatment periods up to about 5 minutes depending on the specific composition of the plastic and the nature of the conductive filler materials therein.

In addition to the copper ions and acid in the conditioner solution, a further essential constituent comprises a polyether compound. Typically, the polyether compound is present in an amount of from about 0.01 to about 10 grams/liter, with amounts of from about 0.05 to about 5 grams/liter being preferred. Suitable polyether compounds include a variety of bath soluble materials with the preferred polyethers being those containing at least 6 ether oxygen atoms and having a molecular weight of from about 150 to about one million. Of the various polyether compounds that can be satisfactorily employed, excellent results have been obtained with the polypropylene or polyethylene glycols as well as mixtures of the foregoing, of an average molecular weight of about 600 to about 4,000 as well as alkoxylated aromatic alcohols having a molecular weight of about 300 to about 2,500. Exemplary of the various preferred polyether compounds which can be satisfactorily employed are those hereafter set forth in Table I.

TABLE I

| | POLYETHERS | |
|---|---|---|
| 1. | Polyethylene glycols | (Ave. M.W. of 400–1,000,000) |
| 2. | Ethoxylated naphthols | (Containing 5–45 moles ethylene oxide groups) |
| 3. | Propoxylated naphthols | (Containing 5–25 moles of propylene oxide groups) |
| 4. | Ethoxylated nonyl phenol | (Containing 5–30 moles of ethylene oxide groups) |
| 5. | Polypropylene glycols | (Ave. M.W. of 350–1,000) |
| 6. | Block polymers of polyoxyethylene and polyoxypropylene glycols | (Ave. M.W. of 350–250,000) |
| 7. | Ethoxylated phenols | (Containing 5–100 moles of ethylene oxide groups) |
| 8. | Propoxylated phenols | (Containing 5–25 moles of propylene oxide groups) |
| 9. | $HO(C_2H_4O)_{5-100}C_2H_4O-C(CH_3)_2-C\equiv C-C(CH_3)_2-C-OC_2H_4(OC_2H_4)_{5-100}OH$ | |
| 10. | $HO(C_2H_4O)_{5-100}C_2H_4O-C(C_2H_5)_2-C\equiv C-C(C_2H_5)_2-OC_2H_4(OC_2H_4)_{5-100}OH$ | |
| 11. | $\left[H_2C(O-CH_2)_2\right]_x$ | Where X = 4 to 375 and the Ave. M.W. is 320 30,000 |

The presence of halogen ions such as chloride ions in the conditioner solution can be tolerated but are preferably reduced to a minimum to avoid an excessive build-up of such halogen ions in the subsequent copper strike solution as a result of drag-out without an intervening rinse step.

Following the conditioning step, the conditioned or activated plastic substrate can be directly transferred to the copper strike electroplating bath without any intervening rinsing and the drag-out from the conditioning bath serves in effect to replenish the copper strike bath. This constitutes still a further advantage of the present process and also eliminates one or more intervening water rinse treatments and the associated costs and problems with the waste treatment thereof. The copper strike solution, unlike other prior art strike solutions for plastics, has a relatively high throwing power resulting in uniform copper deposits during the strike step even in recess or low current density areas of the part. The acid copper electrolyte comprises a more concentrated aqueous acidic solution containing copper ions, acid, a bath soluble polyether compound as well as halogen ions in comparison to the conditioner solution. The copper ions can be introduced employing the same materials as employed in preparing the conditioner solution and the acids similarly are of the same types with sulfuric acid constituting a preferred material to provide a sulfate acid copper bath. The concentration of copper ions in the electrolyte can range from about 15 to about 45 g/l with concentrations of about 25 to about 35 g/l being preferred. The acid concentration can range from about 45 to about 225 g/l with concentrations of about 150 to about 190 g/l being preferred. The polyether compound can be of any of the types employed in the conditioner solution and can generally range from about 0.01 to about 10 g/l with concentrations of about 0.05 to about 5 g/l being preferred.

Additionally, the electrolyte contains halide ions such as chloride and/or bromide anions which are typically present in amounts of at least 20 parts per million but usually not in excess of about 0.5 g/l.

In addition to the polyether compound, it has also been found advantageous in accordance with the practice of the present invention to incorporate one or more additional supplemental brightening agents of the types known in the art to further enhance the brightness, ductility and leveling of the electrodeposited copper strike. A particularly desirable and advantageous supplemental additive comprises organic divalent sulfur compounds including sulfonated or phosphonated organic sulfides, i.e., organic sulfide compounds carrying at least one sulfonic or phosphonic group. These organic sulfide compounds containing sulfonic or phosphonic groups may also contain various substituting groups, such as methyl, chloro, bromo, methoxy, ethoxy, carboxy or hydroxy, on the molecules, especially on the aromatic and heterocyclic sulfide-sulfonic or phosphonic acids. These organic sulfide compounds may be used as the free acids, the alkali metal salts, organic amine salts, or the like. Exemplary of the specific sulfonate organic sulfides which may be used are those set forth in Table 1 of U.S. Pat. No. 3,267,010, and Table III of U.S. Pat. No. 4,181,582 as well as the phosphonic acid derivatives of these. Other suitable organic divalent sulfur compounds which may be used include $HO_3P—(CH_2)_3—S—S—(CH_2)_3—PO_3H$, as well as mercaptans, thiocarbamates, thiolcarbamates, thioxanthates, and thiocarbonates which contain at lease one sulfonic or phosphonic group.

A particularly preferred group of organic divalent sulfur compounds are the organic polysulfide compounds. Such polysulifde compounds may have the formula $XR_1—(S)_nR_2SO_3H$ or $XR_1—(S)_nR_2PO_3H$ wherein $R_1$ and $R_2$ are the same or different alkylene group containing from about 1 to 6 carbon atoms, X is hydrogen $SO_3H$ or $PO_3H$ and n is a number from about 2 to 5. These organic divalent sulfur compounds are aliphatic polysulfides wherein at least two divalent sulfur atoms are vicinal and wherein the molecule has one or two terminal sulfonic or phosphonic acid groups. The alkylene portion of the molecule may be substituted with groups such as methyl, ethyl, chloro, bromo, ethoxy, hydroxy, and the like. These compounds may be added as the free acids or as the alkali metal or amine salts. Exemplary of specific organic polysulfide compounds which may be used are set forth in Table I of column 2 of U.S. Pat. No. 3,328,273 and the phosphonic acid derivatives of these.

Desirably, these organic sulfide compounds are present in the plating baths of the present invention in amounts within the range of about 0.0005 to 1.0 grams per liter.

The electrodeposition of the copper strike is performed with the electrolyte at a temperature of about 60° up to about 120° F., with temperatures of about 60° to 85° F. being preferred. Temperatures above about 85° F. are less desirable due to a progressive loss in the throwing power of the bath. The copper strike is deposited at current densities of about 6 to about 20 amperes per square foot (ASF). Preferably, the strike is deposited with moderate agitation of the electrolyte such as air agitation. Usually the thickness of the copper strike ranges up to about 0.0001 inch.

Following the copper strike step, the plastic article can be transferred to conventional decorative acid copper electroplating or alternative metal plating operations as may be desired. Usually, a decorative acid copper plating is applied to build-up a total copper deposit in accordance with ASEP guidelines as hereinbefore set forth. The bright decorative acid copper bath can typically contain about 140 to about 250 g/l of copper sulfate pentahydrate, about 40 to about 70 g/l sulfuric acid, from about 30 to about 150 parts per million (ppm) halide ions such as chloride ions, along with conventional primary and secondary brightening agents of the types well known in the art and in concentrations typically employed.

Typically, the decorative acid copper plated substrate is next electroplated with a nickel deposit followed by a final decorative chromium deposit.

In order to further illustrate the process of the present invention, the following examples are provided. It will be understood that the examples are provided for illustrative purposes and are not intended to be limiting of the scope of the present invention as herein described and as set forth in the subjoined claims.

EXAMPLE 1

A plastic part comprised of an ABS resin polymer is pretreated to provide an electroless nickel deposit over the surfaces thereof. An aqueous conditioning solution is prepared containing 2 g/l copper sulfate pentahydrate, 7.5 g/l sulfuric acid and 0.1 g/l of polyethylene oxide of a molecular weight of about 4,000. The solution is at a temperature of 75° F.

The plastic part is immersed in the conditioning solution for a period of about 30 seconds and is directly transferred to an aqueous acidic copper strike bath without intervening rinsing. The strike solution contains 75 g/l copper sulfate pentahydrate, 170 g/l sulfuric acid, 2 g/l polyethylene oxide of an average molecular weight of 1,000 and about 60 ppm chloride ions. The conditioned plastic substrate is electroplated with copper in the strike solution at a temperature of 80° F. and at a current density of about 10 ASF for a period of time sufficient to deposit up to 0.0001 inch copper.

The plated substrate is observed as having a uniform, lusterous, semi-bright adherent copper strike deposit.

EXAMPLE 2

A plastic part of an ABS resin polymer having an electroless nickel coating thereon is conditioned in a dilute aqueous acidic conditioning solution at a temperature of 100° F. for a period of one minute. The conditioning solution contains 1 g/l copper sulfate pentahydrate, 4 g/l sodium acid sulfate and 50 ppm of ethoxylated Beta naphthol (10 mols ethylene oxide). The conditioned part is transferred directly without rinsing to the aqueous acidic copper strike solution containing 70 g/l copper sulfate pentahydrate, 165 g/l sulfuric acid, 90 g/l sodium sulfate, 60 ppm chloride ions and 1 g/l ethoxylated Beta naphthol (10 mols ethylene oxide). The copper strike is electrodeposited from the solution at a temperature of 75° F. and at a current density of 15 ASF until a copper plate of 0.0001 inch is effected. An inspection of the copper strike reveals it to be of a uniform, lusterous, semi-bright appearance.

EXAMPLE 3

A plastic part of an ABS resin polymer having an electroless nickel deposit thereon is conditioned in a conditioning solution containing 7 g/l copper sulfate pentahydrate, 5 g/l sulfuric acid and 0.5 g/l of polyethylene oxide of an average molecular weight of 1,000. The conditioning step is performed at a solution temperature of 70° F. for a period of 15 seconds.

The conditioned part is directly transferred to the aqueous acidic copper strike solution without an intervening rinse treatment. The electrolyte of the copper strike bath contains 90 g/l copper sulfate pentahydrate, 40 g/l sulfuric acid, 45 g/l sodium acid sulfate, 90 g/l potassium sulfate, 2 g/l polyethylene oxide (molecular weight 4,000) and about 60 ppm chloride ions. The copper strike is deposited with the electrolyte at a temperature of 85° F. at a current density of 10 ASF until a copper plate of 0.0001 inch is deposited.

An inspection of the copper strike reveals it to be of a uniform, lusterous, semi-bright appearance.

The plastic parts incorporating the copper strike deposited in accordance with Examples 1–3 are thereafter subjected to further copper plating in a conventional decorative acid copper plating solution followed by nickel plating and a final chromium plating step. The composite plated parts are subjected to a thermocycle test in which the parts are heated for a period of one hour at 180° F. followed by a one-half hour at room temperature, followed by a one hour period at −30° F. followed by one-half hour at room temperature before the cycle is again repeated. Such thermocycling testing did not evidence any loss of adhesion of the metal plating indicating good adhesion over the entire surface area of the plastic substrate.

EXAMPLE 4

Two identical plastic panels comprised of an ABS resin polymer are pretreated to provide an electroless nickel deposit over the surfaces thereof.

One of these panels is processed through the aqueous conditioning solution of Example 1, by immersing the panel in the solution for 30 seconds. Thereafter, both panels are placed in the aqueous acidic copper strike bath of Example 1 and electroplated with copper in the strike solution at a temperature of 80° F. and a current density of 10 ASF for 2 minutes.

Upon removing the panels from the strike solution, the panel which had first been processed through the conditioning solution was found to be completely covered with a uniform, lusterous, semi-bright adherent copper strike deposit. The other panel, which had not been processed through the conditioning solution, was found to have significant areas in which electroless nickel was visible.

While it will be apparent that the invention herein disclosed is well calculated to achieve the benefits and advantages as hereinabove set forth, it will be appreciated that the invention is susceptible to modification, variation and change without departing from the spirit thereof.

What is claimed is:

1. A process for pretreating a substantially non-conductive substrate to render it receptive to subsequent electroplating operations which comprises the steps of contacting a substrate with a dilute aqueous conditioning solution containing controlled effective amounts of copper ions, acid and a bath soluble polyether compound for a period of time to effect an immersion deposit of copper on the substate and reduce the resistivity thereof, and thereafter electrolytically depositing on the conditioned substrate a copper strike employing an aqueous acidic electrolyte containing copper ions, acid and a bath soluble polyether compound present in amounts effective to deposit a uniform, adherent and conductive copper strike on the substrate.

2. The process as defined in claim 1 in which said substrate comprises a plateable plastic comprising a polymer containing a conductive filler in at least the surface stratum thereof.

3. The process as defined in claim 1 in which said substrate comprises a plastic having an electroless metal deposit on at least a portion of the surface thereof.

4. The process as defined in claim 1 in which said conditioning solution contains about 0.05 to about 5 g/l copper ions, about 0.5 to about 40 g/l acid and about 0.01 to about 10 g/l polyether compound.

5. The process as defined in claim 1 in which said conditioning solution contains about 0.25 to about 2 g/l copper ions, about 2 to about 25 g/l acid and about 0.05 to about 5 g/l polyether compound.

6. The process as defined in claim 1 in which the conditioning solution is controlled at a temperature of about 60° to about 150° F.

7. The process as defined in claim 1 in which the conditioning solution is controlled at a temperature of about 70° to about 120° F.

8. The process as defined in claim 2 in which the step of contacting the substrate with said conditioning solution is performed for a period up to about 5 minutes.

9. The process as defined in claim 3 in which the step of contacting the substrate with said conditioning solution is performed for a period of about 15 seconds up to a period before adverse chemical attack of the electroless metal deposit occurs.

10. The process as defined in claim 1 in which the step of contacting the substrate with said conditioning solution is performed for a period of about 30 seconds to about 2 minutes.

11. The process as defined in claim 1 in which the step of electrolytically depositing copper on the conditioned substrate is performed directly following the conditioning step without an intervening rinse treatment.

12. The process as defined in claim 1 in which said electrolyte contains about 15 to about 45 g/l copper ions, about 45 to about 225 g/l acid, and about 0.01 to about 10 g/l polyether compound.

13. The process as defined in claim 1 in which said electrolyte contains about 25 to about 35 g/l copper ions, about 150 to about 190 g/l acid, and about 0.05 to about 5 g/l polyether compound.

14. The process as defined in claim 1 in which said electrolyte is controlled at a temperature of about 60° to about 120° F.

15. The process as defined in claim 1 in which the step of electrolytically depositing the copper strike is performed at an average current density of about 6 to about 20 ASF.

16. The process as defined in claim 1 in which the step of electrolytically depositing the copper strike is performed for a period of time to deposit a copper strike up to about 0.0001 inch.

17. The process as defined in claim 1 in which the copper ions are introduced into said conditioning solution and said electrolyte by a bath soluble salt selected from the group consisting of copper sulfate, copper fluoroborate, copper acetate, copper nitrate, the alkali metal and ammonium acid salts thereof as well as mixtures thereof.

18. The process as defined in claim 1 in which said acid in said conditioning solution and said electrolyte is selected from the group consisting of sulfuric acid, fluoroboric acid, acetic acid, nitric acid and mixtures thereof.

19. The process as defined in claim 1 in which said conditioning solution contains copper sulfate to provide copper ions in an amount of about 0.05 to about 5 g/l, sulfuric acid in an amount of about 0.5 to about 40 g/l and a bath soluble polyethylene oxide compound of an average molecular weight of about 4,000 present in an amount of about 0.01 to about 10 g/l.

20. The process as defined in claim 1 in which said electrolyte contains copper sulfate in an amount to provide about 15 to about 45 g/l copper ions, about 45 to about 225 g/l sulfuric acid, about 0.01 to about 10 g/l of said polyether compound, and up to about 0.5 g/l halide ions.

* * * * *